US005528345A

United States Patent [19]

Hasegawa

[11] Patent Number: 5,528,345

[45] Date of Patent: Jun. 18, 1996

[54] FIXING DEVICE HAVING HEAT ROLLER AND PRESSURE ROLLER FOR USE IN IMAGE RECORDING APPARATUS

[75] Inventor: Makoto Hasegawa, Nagoya, Japan

[73] Assignee: Brother Kogyo Kabushiki Kaisha, Nagoya, Japan

[21] Appl. No.: 490,789

[22] Filed: Jun. 15, 1995

[30] Foreign Application Priority Data

Jun. 16, 1994 [JP] Japan ..... 6-134572
Jun. 16, 1994 [JP] Japan ..... 6-134573
Jun. 16, 1994 [JP] Japan ..... 6-134574

[51] Int. Cl.[6] ..... G03G 15/20

[52] U.S. Cl. ..... 355/200; 355/285; 219/216

[58] Field of Search ..... 355/285, 200, 355/282, 290; 2/315; 219/216

[56] References Cited

U.S. PATENT DOCUMENTS 5,218,411 6/1993 Kosugiyama et al. ..... 355/285

FOREIGN PATENT DOCUMENTS 2-100059 4/1990 Japan .

*Primary Examiner*—Joan H. Pendegrass
*Assistant Examiner*—Quana Grainger
*Attorney, Agent, or Firm*—Oliff & Berridge

[57] ABSTRACT

A fixing device having a heat roller and a pressure roller in nipping contact therewith. The heat roller has a sleeve member and a rod-like heater extending through the sleeve member. A casing is provided for housing therein these rollers. The casing includes a lower casing for rotatably supporting the sleeve member and the pressure roller, and an upper casing detachably fixed to the lower casing for covering these rollers. A pair of holder members are fixed to the upper casing for suspending the heater. The upper casing is integrally provided with a sheet peelable guide member at a position adjacent the sleeve member. The guide member separates a curled sheet from the sleeve member. The upper casing is also integrally provided with a heat blocking walls at a position in confrontation with a photosensitive drum. The lower casing is integrally provided with an upstream guide member and a downstream guide member which are positioned upstream and downstream of the pressure roller.

18 Claims, 6 Drawing Sheets

FIXING DEVICE HAVING HEAT ROLLER AND PRESSURE ROLLER FOR USE IN IMAGE RECORDING APPARATUS

BACKGROUND OF THE INVENTION

The present invention relates to a fixing device for use in an electrophotographic image forming apparatus such as a laser printer, copying machine, facsimile, etc.

The image forming apparatus includes an image forming or developing unit where a toner image is formed on an image recording medium or sheet and an image fixing unit where the toner image is fixed to the medium. Several kinds of fixing device have been known such as a non-contact type thermal fixing method using an oven, a photo-fixing method using a flash lamp, a pressure-fixing method using a pair of pressure rollers, and a heat-contact method using a heat roller and a pressure roller.

A conventional fixing device of the heat-contact type includes a frame body having longitudinal end portions provided with bearing portions for supporting axially end portions of the heat roller and the pressure roller. The main frame is also provided with a front guide member for guiding the image recording medium fed from the image forming unit into a fixing region defined between the heat roller and the pressure roller, and a rear guide member for guiding the image recording medium from the fixing region to a discharge guide portion. After these front and rear guide members are attached to the main frame, an upper cover member which is adapted to cover an upper portion of the heat roller is attached to the main frame. Since such conventional fixing device requires great numbers of components and pieces and since neighboring components must undergo position adjustment with each other, intricate assembling work is required and increase in production cost results.

Further, the fixing device is generally positioned downstream of the image forming unit and near the sheet discharge side. If the distance between the image forming unit and the fixing device is reduced in an attempt to provide a compact image recording apparatus, temperature of a toner cartridge etc. in the image forming unit may be elevated due to the heat released from the heat roller of the fixing device, and therefore, the internal toners may be softened to degrade the imaging quality.

In order to overcome this problem, a vent fan is provided to discharge the heated air, or heat insulative partition wall is installed at a boundary between the image forming unit and the fixing device. However, such additional arrangement requires additional assembling work and increase production costs.

In another aspect, in the conventional fixing device of the heat-contact type, the sheet may be curled and wound around an outer peripheral surface of the heat roller due to the heat applied from the heat roller to the sheet. To avoid this, a sheet peel pawl or a peel guide member is attached to the main frame at a position downstream of the heat roller. The pawl or the guide member is positioned extremely close to the outer surface of the heat roller so as to separate the curled sheet from the heat roller.

However, since the imaging surface of the sheet is in slide contact with the sheet peel pawl or the peel guide member after the leading edge of the sheet is separated from the heat roller, the toners at the imaging surface may be transferred and affixed to the pawl or the guide member. If the toner deposition onto the pawl or the guide member is repeatedly carried out, the deposited toner may damage to the imaging surface due to unwanted friction or toner transfer from the deposited toner to the imaging surface. In order to avoid this problem, the peel pawl or the peel guide member can be formed of a material capable of avoiding toner deposition, or the peel pawl or the guide member is coated with the material, which in turn, causes increase in production cost.

Japanese Patent Application Kokai No. Hei 2-100059 discloses a fixing device of the heat-contact type having a pressure roller and a heat roller positioned therebelow. An outer layer of a pressure roller is formed of a resilient material. The heat roller is of a hollow shape having an aluminum sleeve and a resilient layer provided at an outer peripheral surface of the aluminum sleeve. A rod like heat source such as a halogen lamp is disposed in the hollow space of the heat roller.

In order to rotate the pressure roller and the heat roller about their axes, one of the heat roller and the pressure roller is rotationally driven. On the other hand, the halogen lamp is stationarily supported in concentrical or coaxial relation within the sleeve regardless of the rotation of the sleeve so as to uniformly heat the peripheral surface of the sleeve. The halogen lamp is fixed to a position by a fixing component. The both end portions of the halogen lamp have electrodes to which electric current feed electrodes are connected so as to supply electric current to the halogen lamp. A case or a cover is disposed over the heat roller so as to protect an operator against heat when the operator's hand is accessed nearby the heat roller for removing a jammed sheet.

However, the halogen lamp has a limited service life due to the cut-off of a wire after a long term use. Therefore, the halogen lamp must be changed with a new halogen lamp. For the exchanging work, the case or cover must be removed, and the fixing component of the halogen lamp must be removed, and the electric current feed electrodes must be disconnected from the electrodes. Thus, exchanging works requires great labor, and various tools must be used for the replacement.

SUMMARY OF THE INVENTION

It is therefore an object of the present invention to overcome the above described conventional drawbacks and disadvantages and to provide an improved fixing device having a simple construction and being produced at a low cost.

Another object of the invention is to provide such fixing device capable of facilitating assembly and providing sufficient imaging quality.

Still another object of the invention is to provide the fixing device facilitating replacement work of a rod like heater in the heat roller.

These and other objects of the present invention will be attained by providing a fixing device for fixing a developing agent image onto an image recording sheet for use in an image recording apparatus which includes a photosensitive unit for forming a developing agent image in the sheet, the fixing device being positioned downstream of the photosensitive unit in a feeding direction of the sheet, the fixing device including a pressure roller, a heat roller, a lower casing, an upper casing, and upstream and downstream guide members. The pressure roller has axially end portions. The heat roller is positioned in confronting relation with the pressure roller for nipping the image recording sheet carrying thereon the developing agent image so as to apply heat and pressure to the image recording sheet. The heat roller includes a sleeve member having an axially end portions and an elongated heater disposed in the sleeve member. The lower casing is adapted for supporting the pressure roller and the sleeve member of the heat roller at their axially end portions. The upper casing is detachably fixed to the lower casing to define a casing chamber for housing therein the pressure roller and the heat roller. The upper casing integrally provides side walls which covers the axially end portions of the elongated heater. The upstream guide member is positioned upstream of the pressure roller in the sheet feeding direction, and a downstream guide member is positioned downstream of the pressure roller in the sheet feeding direction. The upstream and downstream guide members are provided integrally with the lower casing.

In another aspect of the invention, there is provided a fixing device for fixing a developing agent image onto an image recording sheet for use in an image recording apparatus which includes a photosensitive unit for forming a developing agent image in the sheet, the fixing device being positioned downstream of the photosensitive unit in a feeding direction of the sheet; the fixing device comprising a casing having a pair of side walls, at least one of the side walls being formed with an opening, a heat roller positioned within the casing and having a sleeve member rotatably supported in a horizontal direction by the casing and a pressure roller positioned within the casing and rotatably supported in a horizontal direction by the casing, the pressure roller being in confronting relation with the heat roller for nipping the image recording sheet carrying thereon the developing agent image so as to apply heat and pressure to the image recording sheet, a rod-like heater having axially end portions provided with electrodes, the rod-like heater being positioned within the sleeve member in concentrical relation therewith, the opening of the side wall of the casing allowing the rod-like heater to pass therethrough, a pair of support members fixed in the casing and having engaging portions engageable with the electrodes for suspendingly supporting the rod-like heater, at least one of the engaging portions being positioned in alignment with the opening, and at least one of the support members being resiliently deformable in an axial direction of the rod-like heater.

In still another aspect of the invention, there is provided a fixing device for fixing a developing agent image onto an image recording sheet for use in an image recording apparatus which includes a photosensitive unit for forming a developing agent image in the sheet, the fixing device being positioned downstream of the photosensitive unit in a feeding direction of the sheet; the fixing device comprising a pressure roller having axially end portions and extending in a horizontal direction, a heat roller extending in the horizontal direction and having an outer peripheral surface, the heat roller being positioned in confronting relation with the pressure roller for nipping the image recording sheet carrying thereon the developing agent image so as to apply heat and pressure to the image recording sheet, the heat roller and the pressure roller being aligned in a vertical direction, a lower casing, an upper casing disposed over the lower casing for providing an accommodation space for housing therein the pressure roller and the sleeve member, one of the upper and lower casings covering one of the heat roller and the pressure roller, and remaining one of the lower and upper casing covering remaining one of the pressure roller and the heat roller, and a sheet peelable guide member having an end portion positioned adjacent to the outer peripheral surface of the heat roller and disposed downstream of the heat roller, the sheet peelable guide member being provided integrally with one of the upper and lower casing which covers the heat roller.

DETAILED DESCRIPTION OF THE PREFERRED EMBODIMENTS

Figure 1:
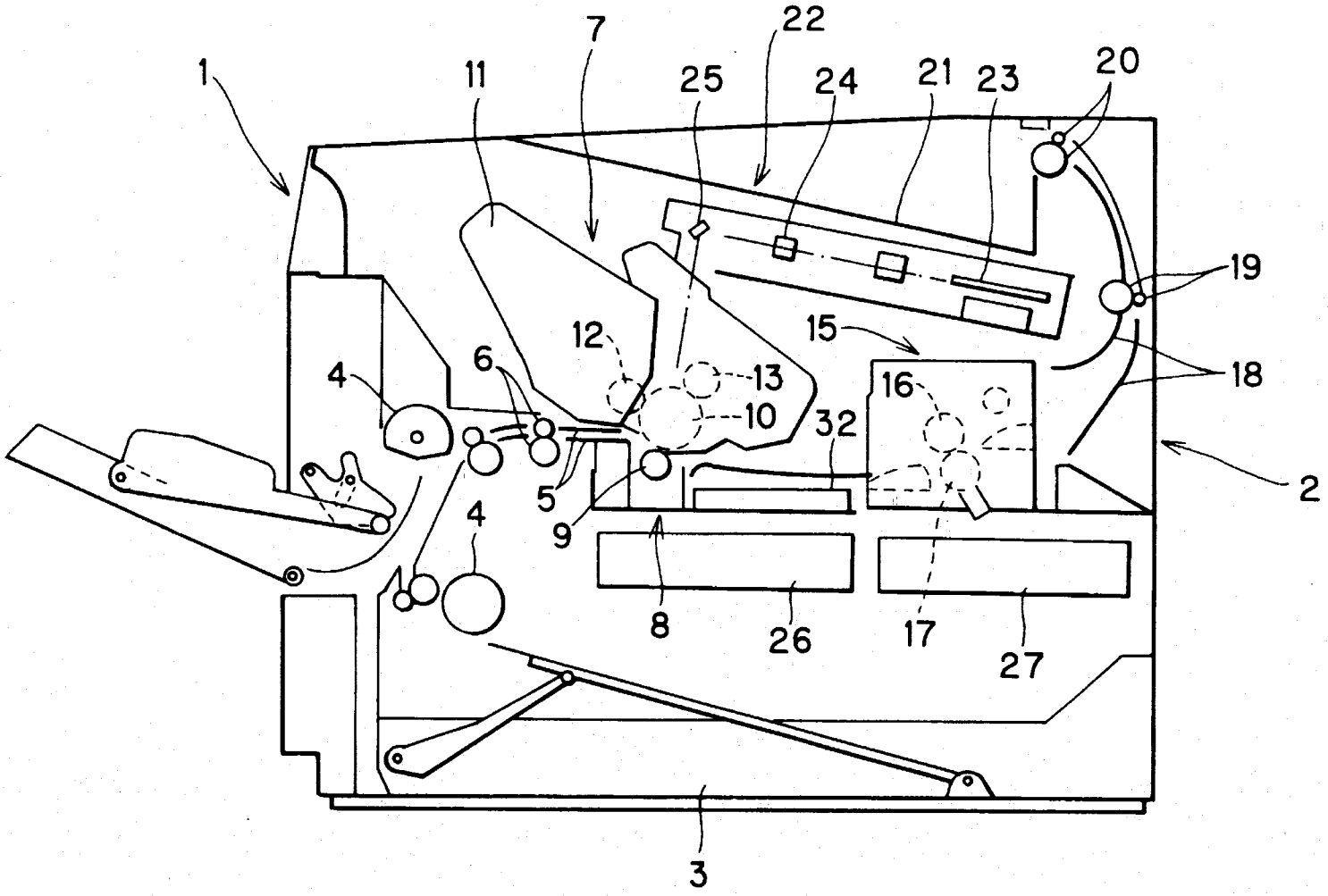
FIG. 1 is a schematic cross-sectional side view showing a laser printer accommodating therein a fixing device according to a first embodiment of the present invention.

A fixing device according to a first embodiment of the present invention will be described. A printer 1 as an image recording apparatus is shown in FIG. 1 in which a fixing device 15 of the embodiment is incorporated.

The printer 1 has a main printer frame 2 and a sheet cassette 3 provided detachably from a lower portion of the main printer frame 2. In the printer 1, a plurality of sheet supply rollers 4 are provided for separating an uppermost sheet P from a remaining sheets of a sheet stack in the cassette 3. A pair of sheet feed rollers 6 are disposed downstream of the sheet supply rollers 4 for feeding the sheet P, via a sheet guide plate 5, to an area between an image forming unit 7 and a transfer roller 9 disposed on a transfer unit table 8. The transfer unit table 8 is formed of an electrically insulative synthetic resin. A feed guide member 32 is disposed downstream of the transfer roller 9. The feed guide member 32 is of fin shape.

The image forming unit 7 is of a single unit which includes a photosensitive drum 10, a developing means 11, a charging means 13 such as a charge roller, and a cleaning means (not shown). The developing means 11 includes a toner tank and a developing roller 12. The developing means 11 is provided in the vicinity of the photosensitive drum 10, whereas the fixing device 15 is positioned opposite the developing means 11 with respect to the photosensitive drum 10, i.e., downstream of the feed guide member 32, The fixing device 15 includes a heat roller 16 and a pressure roller 17, and a fixing region A (See FIG. 4) is provided at a contact portion between the rollers 16 and 17. The heat roller 16 includes a sleeve and a rod-like heater described later. The imaging surface of the sheet P is adapted to contact with the heat roller 16 for image fixing.

At a position above the image forming unit 7, a scanner unit 22 is provided. The scanner unit 22 includes a laser emitting portion 23, a lens 24 and a reflection mirror 25, etc. Further, at a position below the transfer unit table 8, a high voltage substrate 26 is provided for applying high voltage to the charger 13 and the transfer roller 9. Furthermore, at a position below the fixing device 15, a control board 27 is provided.

A sheet discharge guide plate 18 is provided downstream of the fixing device 15, and a pair of intermediate rollers 19 are provided on the sheet passage defined by the guide plate 18. A pair of discharge rollers 20 are provided at an outlet end of the discharge guide plate 18. Further, a discharge tray 21 is provided at an upper portion of the main printer frame 2.

Details of the fixing device 15 will be described with reference to FIGS. 2 through 6. As best shown in FIG. 5, the fixing device 15 includes an upper casing 36 and a lower casing 35 for accommodating therein the heat roller 16 and the pressure roller 17 when assembling these casings together. The upper casing 36 is provided detachably from the lower casing 35, and these casings 36, 35 are formed of an electrically insulative and heat resistant synthetic resin such as an epoxy resin, phenol resin, urea resin, melamine resin, and ABS resin, etc., and is produced by injection molding.

Figure 2:
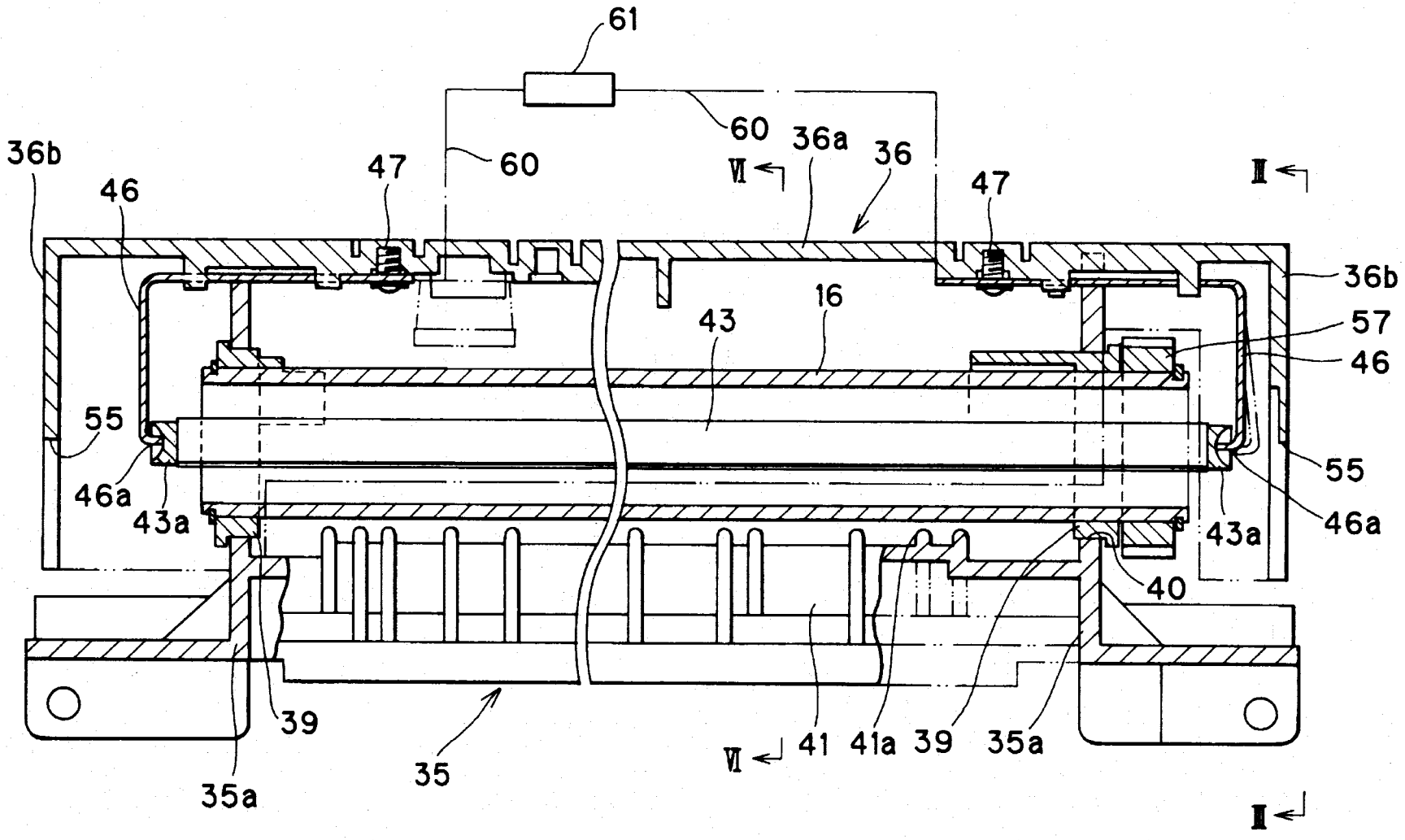
FIG. 2 is a vertical cross-sectional view showing the fixing device according to the embodiment.
Figure 3:
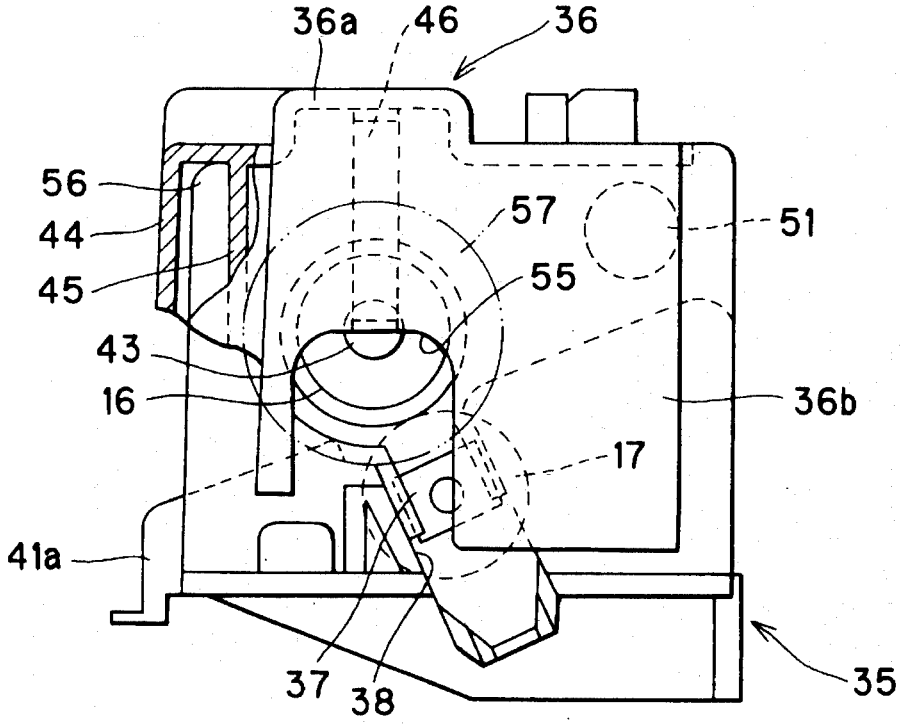
FIG. 3 is a side view as viewed from an arrow III—III of FIG. 2.

More specifically, the lower casing 35 has a pair of end plates 35*a*, 35*a* for supporting the sleeve of the heat roller 16 and the pressure roller 17. To this effect, each end plate 35*a* is formed with a circular hole 40 and an elongated slot 38 extending downwardly from the circular hole 40 and contiguous with the circular hole 40. As shown in FIGS. 2 and 3, the sleeve of the heat roller 16 has circular bearing portions 39, 39 at axially end portions thereof, and the pressure roller 17 has rectangular bearings 37, 37 at axially end portions thereof. Each circular bearing portion 39 is supported by each circular hole 40, and each rectangular bearing 37 is vertically movably supported in each slot 38. Coil springs (not shown) are provided for urging the bearings 37 upwardly, to thereby bring the upper surface of the pressure roller 17 into contact with the lower surface of the sleeve of the heat roller 16. Each end plate 35*a* has an upper portion provided with a female thread portions 53.

The lower casing 35 is integrally provided with an upstream guide member 41 and a downstream guide member 42. The upstream guide member 41 is positioned upstream of the pressure roller 17 and extends in a direction parallel with an axial direction of the pressure roller 17. The upstream guide member 41 includes a rib base 41*b* whose longitudinal ends are integral with the end plates 35*a*, 35*a*, and a plurality of ribs 41*a* projecting upwardly from the rib base 41*b* and arrayed in the longitudinal direction of the rib base 41*b* with an equal interval between neighboring ribs 41*a* and 41*a*. The downstream guide member 42 is positioned downstream of the pressure roller 17 and extends in a direction parallel with the axial direction of the pressure roller 17. The downstream guide member 42 includes a rib base 42*b* whose longitudinal ends are integral with the end plates 35*a*, 35*a*, and a plurality of ribs 42*a* projecting upwardly from the rib base 42*b* and arrayed in the longitudinal direction of the rib base 42*b* with an equal interval between neighboring ribs 42*a* and 42*a*. The rib base 42*b* is positioned higher than the rib base 41*b*.

Figure 4:
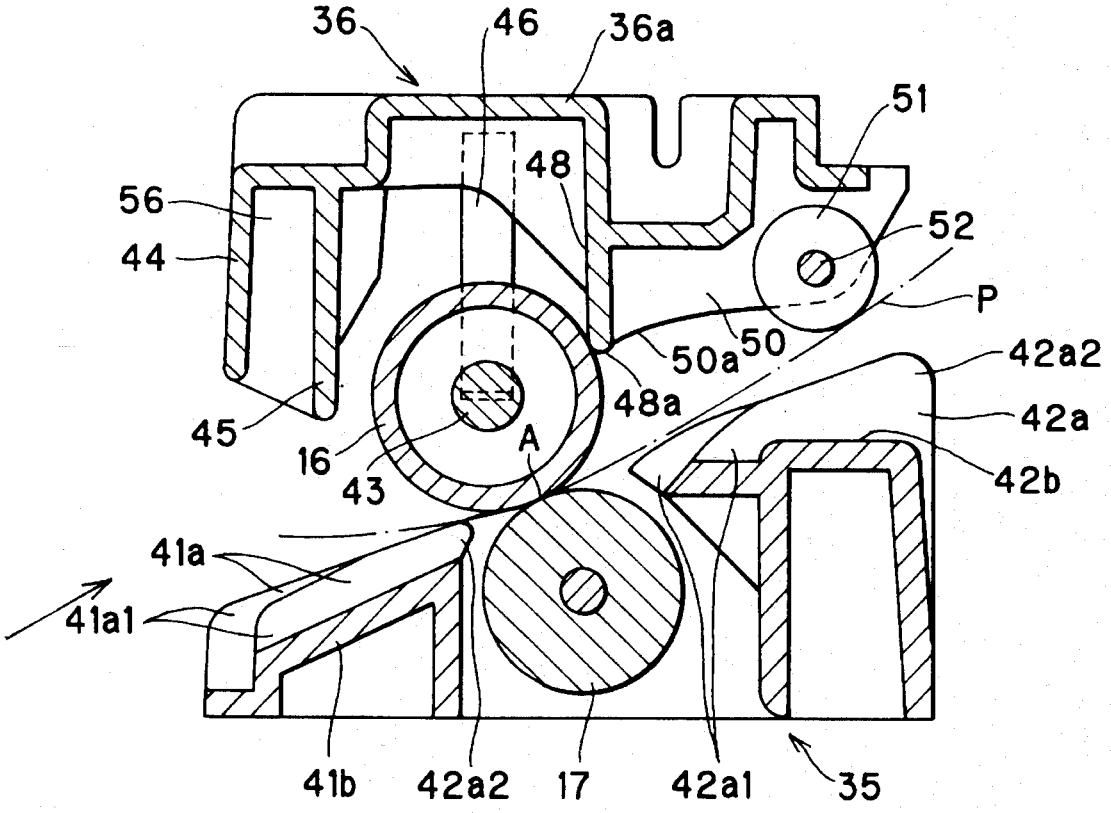
FIG. 4 is a cross-sectional view taken along the line VI—VI of FIG. 2.
Figure 5:
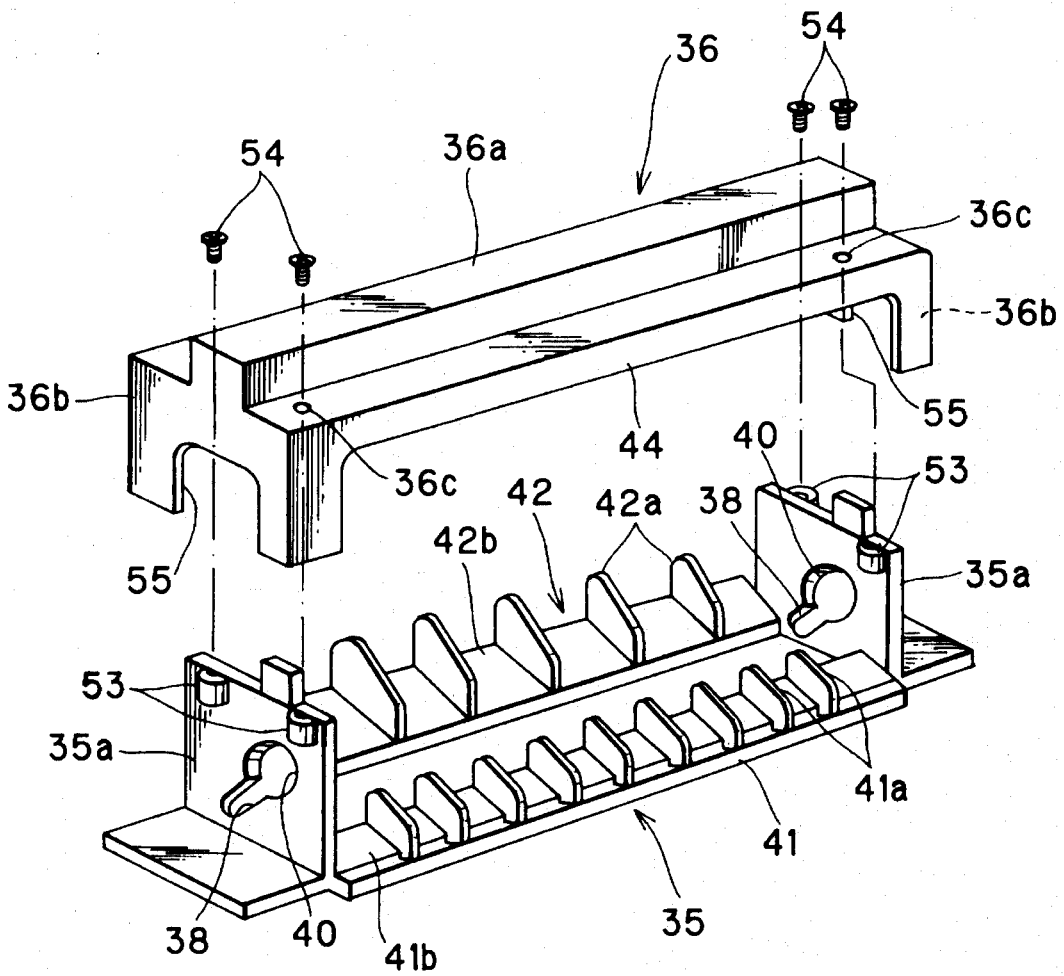
FIG. 5 is an exploded segmental perspective view showing a lower casing and an upper casing according to the embodiment.

As shown in FIG. 4, an upper contour of the ribs 41*a* have inlet ends 41*a*1 and outlet ends 41*a*2. The inlet ends 41*a*1 are positioned lower than the outlet ends 41*a*2 which are positioned close to the fixing region A. Thus, the upper contour of the ribs 41*a* is slanted upwardly toward the fixing region A. Similarly, an upper contour of the ribs 42*a* have inlet ends 42*a*1 and outlet ends 42*a*2. The inlet ends 42*a*1 are positioned close to the fixing region A and are positioned lower than the outlet ends 42*a*2 which is positioned at a vertical level approximately equal to that of the upper surface of the heat roller 16. Thus, the upper contour of the ribs 42*a* is slanted upwardly toward the discharge guide plate 18.

The heat roller 16 is made up of the sleeve member made of high heat conductive material such as aluminum, an elastic layer disposed over the sleeve member and made of silicone rubber or silicone resin, and a parting or release agent layer formed over the elastic layer. The parting agent layer is made of a parting material such as polytetrafluoroethylene, tetrafluoroethylene-perfluoroalkylvinylether copolymer. Because of the release agent layer, so called offsetting phenomena can be avoided, the offsetting being such that the softened toner on the sheet P is transferred onto the heat roller during fixing and the transferred toner is transferred to a subsequent sheet P to degrade imaging quality. The sleeve member of the heat roller 16 has one distal end fixedly mounted with a driven gear 57 meshedly engaged with a drive gear (not shown) for rotating the sleeve of the heat roller 16 about its axis.

As best shown in FIG. 2 an elongated or rod-like heater such as a halogen lamp 43 extends through the hollow space of the sleeve member for uniformly heating the peripheral surface of the heat roller 16 at a temperature of 170° C. to 200° C. An axial length of the heater 43 is greater than that of the sleeve, so that both axial end portions of the heater 43 protrude from the axial edge of the sleeve. The axial end portions of the heater 43 are provided with electrodes 43*a*, 43*a* which protrude out of the sleeve of the heat roller 16. A pair of holders 46, 46 are provided for suspending the heater 43 at the axially end portions thereof in such a manner that heater 43 is positioned coaxially with the sleeve.

Figure 6:
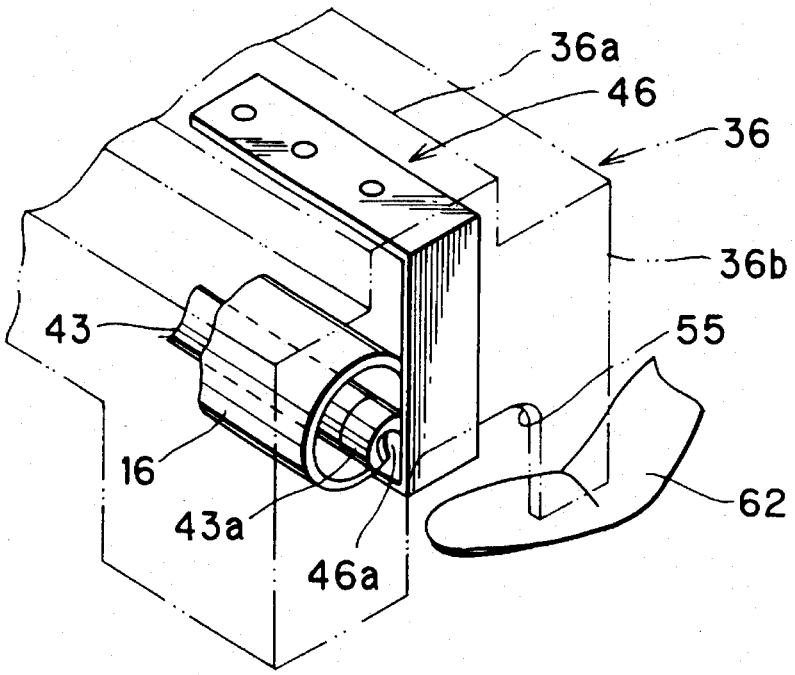
FIG. 6 is a partial perspective view for description of attachment and detachment of a heater according to the embodiment.
Figure 7:
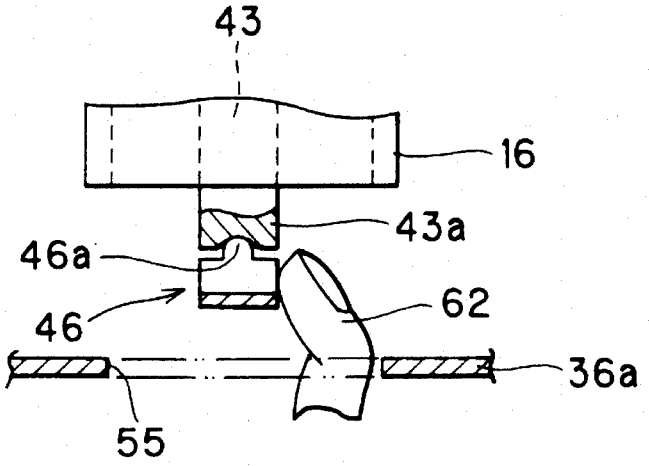
FIG. 7 is a cross-sectional view for description of attachment and detachment of the heater according to the embodiment.

As shown in FIG. 5, the upper casing 36 has a top wall 36*a* extending by a length to dispose over the elongated halogen lamp 43, and side walls 36*b*, 36*b* extending downwardly from the axial ends of the top wall 36*a* for covering the protruded end portions of the halogen lamp 43. Each side wall 36*a* has a lower portion formed with an opening 55 opened at a lower end of the side wall 36*b*. The pair of holders 46, 46 are suspendingly fixed to the top wall 36*a* of the upper casing 36 by screws 47, 47 as shown in FIG. 2. As described above, the holders 46, 46 are adapted to support the halogen lamp 43, and further are adapted to feed electrical current to the electrodes 43*a*, 43*a* of the halogen lamp 43. To this effect, the holders 46, 46 are formed of metallic plate and have L-shape having resiliency. Each free end portion of the L-shaped holder 46 is bent inwardly to provide an engaging portion 46*a*. Each electrode 46*a* of the heater 43 is formed with a recessed portion with which the engaging portion 46*a* is detachably engageable as shown by a solid line and a dotted chain line in FIG. 2. Each engaging portion 46*a* is positioned within an area of the opening 55 as shown in FIGS. 2 and 6 so that an operator's finger 62 can access the connecting portion 46*a* through the opening 55.

The screws 47 are connected to an electrical line 60 which is connected to a power circuit 61 which may be provided at the control substrate 27 for supplying electrical current to the heater 43.

As shown in FIGS. 3 and 4, two heat blocking walls 44, 45 integrally protrudes downwardly from the upper wall 36*a* of the upper casing 36 and extend along a length of the heat roller 16 at a position in confrontation with the image forming unit 7. The heat blocking walls 44, 45 have protruding length capable of covering at least upper half portion of the heat roller 16. An air stagnant space 56 is defined among the top wall 36*a* and the confronting heat blocking walls 44, 45.

As shown in FIG. 4, the top wall 36*a* of the upper casing 36 has a downstream portion from which a sheet peel member 48 protrudes downwardly. The sheet peel member 48 has a lower edge portion 48*a* positioned close to the downstream half portion of the heat roller 16 by a gap distance of 0.2 mm to 0.5 mm. The sheet peel member 48 extends in a direction parallel with the axial direction of the heat roller 16 and has a length approximately equal to the heat roller 16.

Further, a plurality of ribs 50 protrude downwardly from the downstream portion of the top wall 36*a*. These ribs 50 are spaced from each other in the axial direction of the heat roller 16. Each lower edge 50*a* of the rib 50 is aligned with the sheet peel guide member 48. The rib 50 extends in a direction perpendicular to the sheet peel guide member 48. Moreover, the lower edge 50*a* of the rib 50 is arcuately formed so as to cure curling of the sheet P. That is, as shown in FIG. 4, the sheet P may be curled toward the heat roller 16 when passing between the heat roller 16 and the pressure roller 17. The curling direction is counerclockwise direction in FIG. 4. However, by arcuately forming the lower edge 50*a* of the rib 50, the curling of the sheet can be corrected because the lower edge 50*a* arches in a direction opposite to the direction in which the sheet P curls. Stated differently, the arc of the lower edge 50*a* is oriented to face in the direction opposite the direction in which the curl of the sheet P faces.

Furthermore, an idle roller 52 is rotatably positioned between the neighbouring ribs 50 and 50. The idle roller 52 is adapted to smoothly change feeding direction of the printed sheet P. The idle roller is integrally provided with a rotation shaft 51 which is rotatably supported by a notched holes formed in ribs 50. The rotation shaft 51 is snappingly inserted in the notched holes because of resilient deformation of the ribs 50. A lower half portion of the idle roller 51 protrudes from the lower edge of the rib 50 as shown in FIG. 4. A plurality of idle rollers 50 are provided, and each idle roller is positioned between the neighbuoring ribs 50 and 50.

The top wall 36*a* of the upper casing 36 has thread holes 36*c* with which screws 54 are threadingly engageable. The screws 54 are also threadingly engageable with the female thread portions 53 provided at end plates 35*a* of the lower casing 35 for detachably fixing the upper casing 36 to the lower casing 35.

As described above, the lower casing 35 integrally provides the upstream guide plate 41, the downstream guide plate 42 and has bearing support portions 40, 38 for supporting the heat roller 16 and the pressure roller 17. On the other hand, the upper casing 26 integrally provides the plurality of heat blocking walls 44, 45. Therefore, a resultant fixing device can be easily assembled or provided by merely fixing the upper casing 36 to the lower casing 35 after installing the pressure roller 17 and the heat roller 16 into the lower casing 35. Consequently, production cost can be lowered. In other words, it is unnecessary to independently provide the upstream guide plate, the downstream guide plate, nor the heat blocking walls.

Further, since the sheet peel member 48 is provided integrally with the case 36 which accommodates the heat roller 16, mere accommodation of the heat roller 16 into the case 36 can provide positional relationship to the sheet peel member 48 at a position immediately downstream of the heat roller 16. Stated differently, the assembling work of the fixing device can be facilitated.

In operation, for forming a visible image on the sheet P, the photosensitive drum 10 is provisionally charged by the charger 13. A laser beam is irradiated from the scanner unit 22 in accordance with image data transmitted from an external equipment such as a host computer (not shown) onto the outer peripheral surface of the drum 10. Therefore, an electrostatic latent image is formed on the surface of the photosensitive drum 10. Then, the developing roller 12 is rotated while supplying electrically charged developing agents to the surface of the photosensitive drum 10 so as to convert the latent image into a visible developing agent image. Then, the developing agent image is transferred onto the sheet P fed between the photosensitive drum 10 and the transfer roller 9.

The sheet P is fed past the feed guide plate 32 and thereafer, heat and pressure is applied to the transferred image at the fixing region A of the fixing device 15 for fixing the developing agent image onto the sheet P. In this case, heat released from the heat roller 16 can be blocked by the heat blocking walls 44, 45 provided at the upper casing 36. Since the combination of the heat blocking walls 44, 45 and the top wall 36*a* provides the air stagnant space 56, adiabatic effect can be provided because of the low heat conductivity of air. Consequently, heat radiation and heat convection toward the image forming unit 7 can be effectively prevented, so that softening of toners in the image forming unit 7 can be obviated, and image degradation as a result of long period of use is avoidable.

Further, since the axially end portions of the rollers 16 and 17 are covered by the side walls 36*b*, 36*b* of the upper casing 36, operator's finger can be protected against the rotating rollers by the side walls during maintenance work, resulting in a safety device. Moreover since the axial end portions of the heater are covered by the side walls, the operator can be protected against burn or scald during maintenance.

When the sheet P carrying the toner image thereon passes through the fixing region A, the leading end portion of the sheet P may be curled due to the heat to surround the peripheral surface of the heat roller 16. However, the leading end portion of the sheet P is peeled from the heat roller 16 by the lower end portion 48*a* of the sheet peel guide member 48. The leading edge of the peeled sheet P is in sliding contact with the lower edges 50*a* of the ribs 50 during the feeding of the sheet P. In this case, only the leading edge of the sheet P which has been curled after passing through the heat roller 16 is in slide contact with the arcuate lower edge 50*a*, and the leading edge of the sheet P reaches the idle roller 50. Therefore, the toner image can be protected when passing through the lower edge 50*a* of the rib 50. In other words, if the arc of the lower edge 50*a* of the rib 50 is in the curling direction of the sheet P, the toner image carried on the sheet P is in slide contact with the arcuate lower edge 50*a* to degrade the image.

Further, due to the heat, the sheet peel guide member 48 may apt to be deformed. However, since the plurality of ribs 50 extend in the direction perpendicular to the extending direction of the sheet peel guide member 48, the position of the sheet peel guide member 48 can be regulated or restricted by the ribs 50. Accordingly, variation in gap between the heat roller 16 and the sheet peel guide member 48 can be reduced.

The feeding direction of the sheet P toward the intermedaite roller 19 is changed by the idle rollers 52. The idle roller 52 prevents the sheet P from being in direct contact with a downstream end corner of the casing 36, and therefore, the imaging surface can be protected.

When the leading edge portion of the sheet P is nipped between the intermediate rollers 19 and is then fed by the intermediate rollers 19, the upper surface of the sheet P which may be curved toward the heat roller 16 is not any more in slide contact with the lower edges of the ribs 50, but is in rolling contact with the idle roller 51. Therefore, toner image fixed onto the sheet P can be protected against friction, scratch or peeling.

The sheet P is discharged onto the discharge tray 21 by way of the pair of intermediate rollers 19 and the pair of discharge rollers 20.

For assembling the fixing device, the pressure roller 17 and the sleeve portion of the heat roller 16 are installed onto the lower casing 35, while the idle roller 51 is installed onto the upper casing 36. Then, the top wall 36*a* of the upper casing 36 is mounted on the top edges of the end plates 35*a*, 35*a* of the lower casing 35, and the upper casing 36 is fixed to the lower casing 36 by screws 54 threadingly engaging with the female thread portions 53 as shown in FIG. 5. Since the outer casing is divided into the upper and lower casing halves, the fixing device can be easily disassembled.

Then, the rod like heater 43 is inserted, through the one of the openings 55 of the one of the side walls 36*b* of the upper casing 36, into the inner hollow space of the sleeve portion of the heat roller 16. The rod like heater is moved in the axial direction, so that the recessed portion of the electrode 43*a* at the deep end of the heater 43 is depressedly engaged with the engaging portion 46*a* of the holder member 46. In this case, the engagement between the electrode 43*a* and the engaging portion 46*a* is maintained by the assistance of a finger 62 as shown in FIG. 6. Further, the other holder member 46 is resiliently deformed by a finger, so that the other holder member 46 is moved away from the other electrode 43*a* as shown by the two dotted chain line in FIG. 2, whereby other engaging portion 46*a* of the holder member 46 is brought into engagement with the other recessed portion of the other electrode 46*a* upon releasing the holder member 46 from the finger. As a result, the heater 43 is suspendingly supported by the holder member 46, 46 with the latter being urged toward the electrodes 43*a*, 43*a* in the axial direction of the heater. After installation of the heater 43, rotation of the heater 43 about its axis is prevented because of the resilient urging force from the holder members 46 46. Replacement of the heater 43 by a new heater can be made in the reverse order without removal of the upper casing 36 from the lower casing 35.

Since the holder members 46, 46 are made of metal, the holder members can also serve as electric power feeding means, which facilitate attachment and detachment work of the heater 43. Further, since the holder members 43, 43 are surrounded by the upper casing 36, an operator is protected against electrification or shock during power feeding. Moreover, the above-described replacement work can be done easily without any tool.

Figure 9:
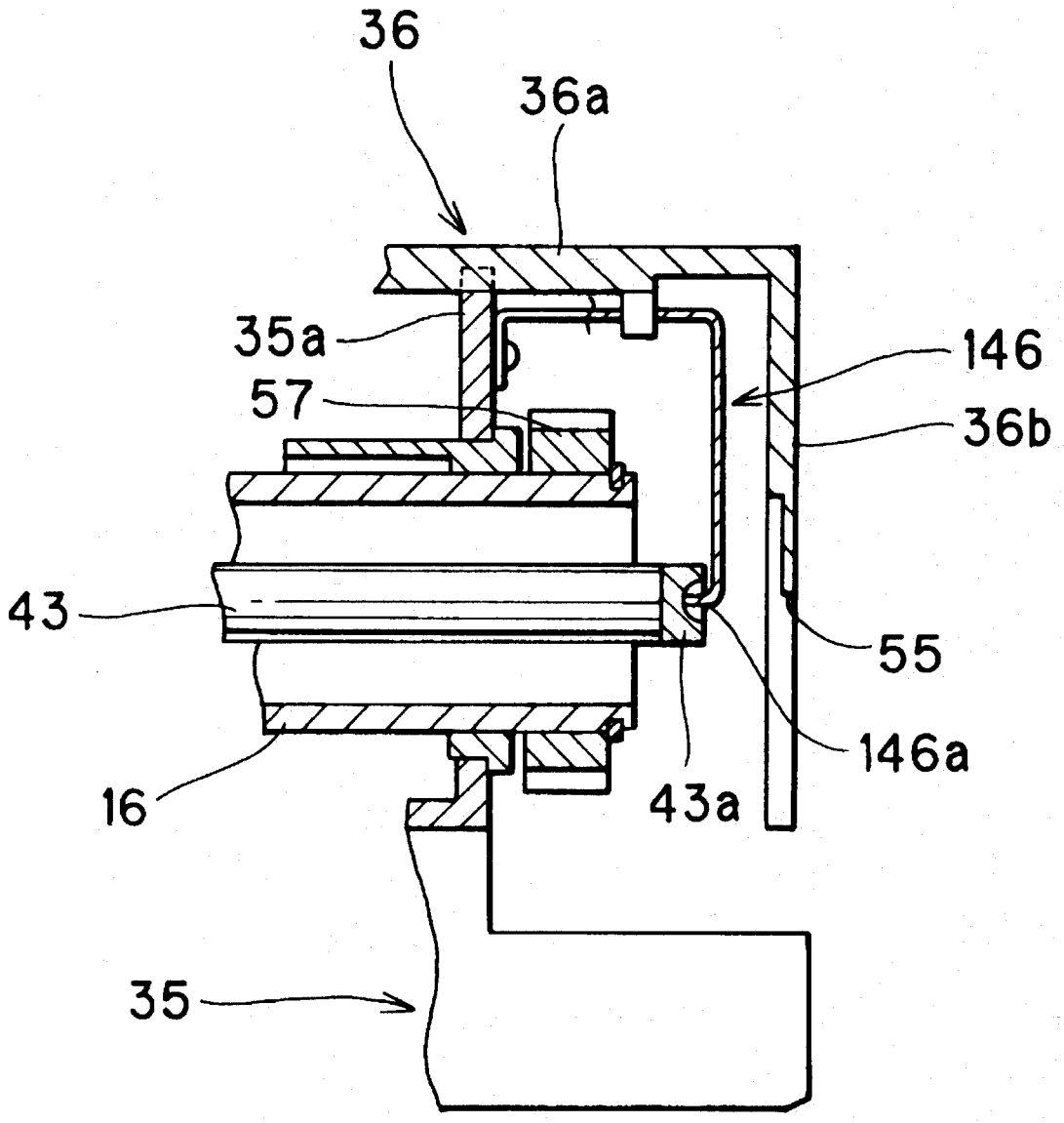
FIG. 9 is a cross-sectional view showing an essential portion of heater supporting structure in a fixing device according to a second embodiment of the present invention.

A fixing device according to a second embodiment of the invention will next be described with reference to FIG. 9. In the first embodiment, the base end of the holder members 46, 46 are fixed to the top wall 36*a* of the upper casing 36. In the second embodiment, base end of the holder member 146, 146 is fixed to the side walls 35*a*, 35*a* of the lower casing 35. Each free end of the holder member 146, 146 is bent inwardly to provide engagement portions 146*a*, 146*a* for supporting electrodes 43*a*, 43*a* of the heater 43.

With this arrangement, the upper casing 36 can merely be disposed over the lower casing 35, after the pressure roller 17, the sleeve portion of the heat roller 16 and the heater 43 are installed to the lower casing 35. In other words, it is unnecessary to install the heater 43 after installing the upper casing over the lower case. Further, replacing the heater 43 with a new heater can be made through the above described openings 55, 55, or the heater replacement work can be made by removing the upper casing 36 from the lower casing 35.

Figure 8:
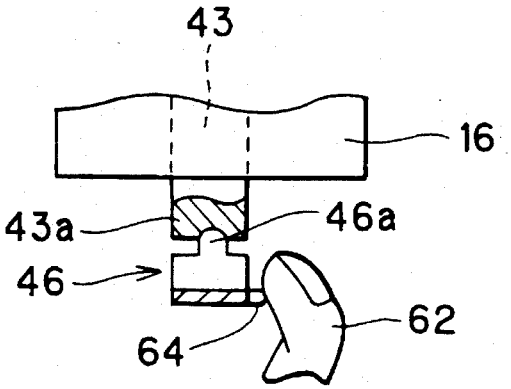
FIG. 8 is a cross-sectional view for description of attachment and detachment of a heater according to a modified embodiment.

While the invention has been described in detail and with reference to the specific embodiment thereof, it would be apparent to those skilled in the art that various changes and modifications may be made therein without departing from the spirit and scope of the invention. For example, the present invention is applied to other electrostatic photography device such as a copying machine and a facsimile machine. Further, in the depicted embodiment, two heat blocking walls 44 and 45 are provided. However, three or more heat blocking walls can be provided integrally with the top wall of the upper casing. Further, as shown in FIG. 8, for facilitating replacement work of the heater 43, a latch 64 can be provided at one vertical side of the holder 46. The latch 64 can facilitate engagement of the finger 62 with the holder 46.

Further, in the depicted embodiment, the heat roller 16 is positioned above the pressure roller 17. However, the heat roller 16 can be positioned below the pressure roller 17. To this effect, the heat roller is disposed in the lower casing 35. In the latter case, since the imaging surface on the sheet P is to be faced with the heat roller, a sheet peel guide member is provided integrally with the downstream guide plate of the lower casing in which a free end of the sheet peel guide member is directed upwardly so as to separate a curled leading end portion of the sheet from the heat roller. Moreover, in the latter case, a plurality of ribs (like ribs 50) are provided integrally with the downstream guide plate in such a manner that upper edgelines of the ribs are curved in a concaved fashion so as to correct curling of the sheet P. Furthermore, in the latter case, idle rollers (like rollers 51) are rotatably provided to the ribs similar to the arrangement shown in FIG. 4.

What is claimed is:

1. A fixing device for fixing a developing agent image onto an image recording sheet for use in an image recording apparatus which includes a photosensitive unit for forming a developing agent image in the sheet, the fixing device being positioned downstream of the photosensitive unit in a feeding direction of the sheet; the fixing device comprising:

a pressure roller having axially end portions;

a heat roller positioned in confronting relation with the pressure roller for nipping the image recording sheet carrying thereon the developing agent image so as to apply heat and pressure to the image recording sheet, the heat roller comprising a sleeve member having an axially end portions, and an elongated heater disposed in the sleeve member;

a lower casing for supporting the pressure roller and the sleeve member of the heat roller at their axially end portions;

an upper casing detachably fixed to the lower casing to define a casing chamber for housing therein the pressure roller and the heat roller, the upper casing integrally providing side walls which covers the axially end portions of the elongated heater; and an upstream guide member positioned upstream of the pressure roller in the sheet feeding direction and a downstream guide member positioned downstream of the pressure roller in the sheet feeding direction, the upstream and downstream guide members being provided integrally with the lower casing.

2. The fixing device as claimed in claim 1, wherein the upstream guide member and the downstream guide member provide a sheet passage in alignment with a nipping point between the pressure roller and the heat roller.

3. The fixing device as claimed in claim 1, wherein at least one side wall of the upper casing is formed with an opening, and wherein the elongated heater has axially end portions provided with electrodes, the elongated heater being positioned within the sleeve member in concentrical relation therewith, the opening of the side wall of the upper casing allowing the elongated heater to pass therethrough.

4. The fixing device as claimed in claim 3, further comprising a pair of support members fixed to the upper casing and having engaging portions engageable with the electrodes for suspendingly supporting the elongated heater in the sleeve member.

5. The fixing device as claimed in claim 4, wherein at least one of the engaging portions is positioned in alignment with the opening, and at least one of the support members is resiliently deformable in an axial direction of the elongated heater.

6. The fixing device as claimed in claim 5, wherein the lower casing has a pair of side plates for rotatably supporting the axially end portions of the sleeve member and the pressure roller, and the pair of side walls of the upper casing are positioned outside of the side plates.

7. The fixing device as claimed in claim 6, wherein the each of the support members has a base end fixed to the upper casing and a free end provided with the engaging portion.

8. The fixing device as claimed in claim 7, wherein the pair of support members are formed of an electrically conductive material for feeding a power to the electrodes.

9. The fixing device as claimed in claim 1, further comprising a plurality of heat blocking walls provided integrally with the upper casing at a position confrontable with the image forming unit.

10. The fixing device as claimed in claim 1, further comprising a sheet peelable guide member having an end portion positioned adjacent to the heat roller and disposed downstream of the heat roller, the sleeve member of the heat roller having a major outer peripheral area covered by one of the upper and lower casings, the sheet peelable guide member being provided integrally with one of the upper and lower casings which covers the major outer peripheral area.

11. The fixing device as claimed in claim 10, wherein the one of the upper and lower casings which covers the major outer peripheral area of the sleeve member further comprises a plurality of ribs each extending in the sheet feeding direction and at a position downstream of the sheet peelable guide member, each rib having upstream end portion in alignment with the end portion of the sheet peelable guide member.

12. The fixing device as claimed in claim 11, wherein each rib has an edgeline along the sheet feeding direction, the edgeline being arcuate in a concave fashion for changing a curling direction of the image recording medium at its leading end portion to a direction opposite an arc defined by a cross-section of the sleeve member.

13. The fixing device as claimed in claim 12 further comprising at least one idle roller rotatably supported to the ribs at a position spaced away from the sheet peelable guide member.

14. A fixing device for fixing a developing agent image onto an image recording sheet for use in an image recording apparatus which includes a photosensitive unit for forming a developing agent image in the sheet, the fixing device being positioned downstream of the photosensitive unit in a feeding direction of the sheet; the fixing device comprising:

a casing having a pair of side walls, at least one of the side walls being formed with an opening;

a heat roller positioned within the casing and having a sleeve member rotatably supported in a horizontal direction by the casing and;

a pressure roller positioned within the casing and rotatably supported in a horizontal direction by the casing, the pressure roller being in confronting relation with the heat roller for nipping the image recording sheet carrying thereon the developing agent image so as to apply heat and pressure to the image recording sheet;

a rod-like heater having axially end portions provided with electrodes, the rod-like heater being positioned within the sleeve member in concentrical relation therewith, the opening of the side wall of the casing allowing the rod-like heater to pass therethrough;

a pair of support members fixed in the casing and having engaging portions engageable with the electrodes for suspendingly supporting the rod-like heater, at least one of the engaging portions being positioned in alignment with the opening, and at least one of the support members being resiliently deformable in an axial direction of the rod-like heater.

15. The fixing device as claimed in claim 14, wherein the casing comprises:

a lower casing having a pair of side plates for rotatably supporting the sleeve member of the heat roller and the pressure roller; and an upper casing having a top wall and the pair of side walls positioned outside of the side plates, the upper casing being fixed to the lower casing for housing therein the heat roller and the pressure roller.

16. The fixing device as claimed in claim 15, wherein the each of the support members has a base end fixed to the upper casing and a free end provided with the engaging portion.

17. The fixing device as claimed in claim 16, wherein the pair of support members are formed of an electrically conductive material for feeding a power to the electrodes.

18. A fixing device for fixing a developing agent image onto an image recording sheet for use in an image recording apparatus which includes a photosensitive unit for forming a developing agent image in the sheet, the fixing device being positioned downstream of the photosensitive unit in a feeding direction of the sheet; the fixing device comprising:

a pressure roller having axially end portions and extending in a horizontal direction;

a heat roller extending in the horizontal direction and having an outer peripheral surface, the heat roller being positioned in confronting relation with the pressure roller for nipping the image recording sheet carrying thereon the developing agent image so as to apply heat and pressure to the image recording sheet, the heat roller and the pressure roller being aligned in a vertical direction;

a lower casing;

an upper casing disposed over the lower casing for providing an accommodation space for housing therein the pressure roller and the sleeve member, one of the upper and lower casings covering one of the heat roller and the pressure roller, and remaining one of the lower and upper casing covering remaining one of the pressure roller and the heat roller;

a sheet peelable guide member having an end portion positioned adjacent to the outer peripheral surface of the heat roller and disposed downstream of the heat roller, the sheet peelable guide member being provided integrally with one of the upper and lower casing which covers the heat roller.

* * * * *